United States Patent [19]

Dewing

[11] Patent Number: 4,647,357

[45] Date of Patent: Mar. 3, 1987

[54] ALUMINIUM ELECTROLYTIC REDUCTION CELL LININGS

[75] Inventor: Ernest W. Dewing, Kingston, Canada

[73] Assignee: Alcan International Limited, Montreal, Canada

[21] Appl. No.: 617,722

[22] Filed: Jun. 6, 1984

[30] Foreign Application Priority Data

Jun. 13, 1983 [GB] United Kingdom ..... 8316058

[51] Int. Cl.[4] ..... C25C 3/08; C25B 11/04

[52] U.S. Cl. ..... 204/243 R; 204/291

[58] Field of Search ..... 204/243 R, 244–247, 204/67, 294, 291

[56] References Cited

U.S. PATENT DOCUMENTS

| | | | |
|---|---|---|---|
| 3,457,158 | 7/1969 | Bullough | 204/67 X |
| 3,723,286 | 3/1973 | Hunt et al. | 204/243 R |
| 4,033,836 | 7/1977 | Holmes | 204/243 R X |
| 4,175,022 | 11/1979 | Vadla et al. | 204/243 R |
| 4,383,910 | 5/1983 | Richards | 204/294 X |
| 4,411,758 | 10/1983 | Hess et al. | 204/243 R |
| 4,430,187 | 2/1984 | Snaelund et al. | 204/243 R |

*Primary Examiner*—Donald R. Valentine

*Attorney, Agent, or Firm*—Cooper, Dunham, Griffin & Moran

[57] ABSTRACT

The invention concerns cells for production of Al by electrolysis of an alumina-containing electrolyte based on cryolite and having a lining based on alumina for containing the electrolyte. A layer containing an alkali or alkaline earth metal compound, e.g. sodium aluminate, is included in the lining, preferably around the 880° C. isotherm when the cell is in operation. On penetration of the lining by the electrolyte, the compound dissolves in or reacts with the electrolyte so as to raise the solidus and reduce or prevent further penetration.

7 Claims, 2 Drawing Figures

THE BINARY SYSTEM NaF-$AlF_3$

ALUMINIUM ELECTROLYTIC REDUCTION CELL LININGS

Figure 1:
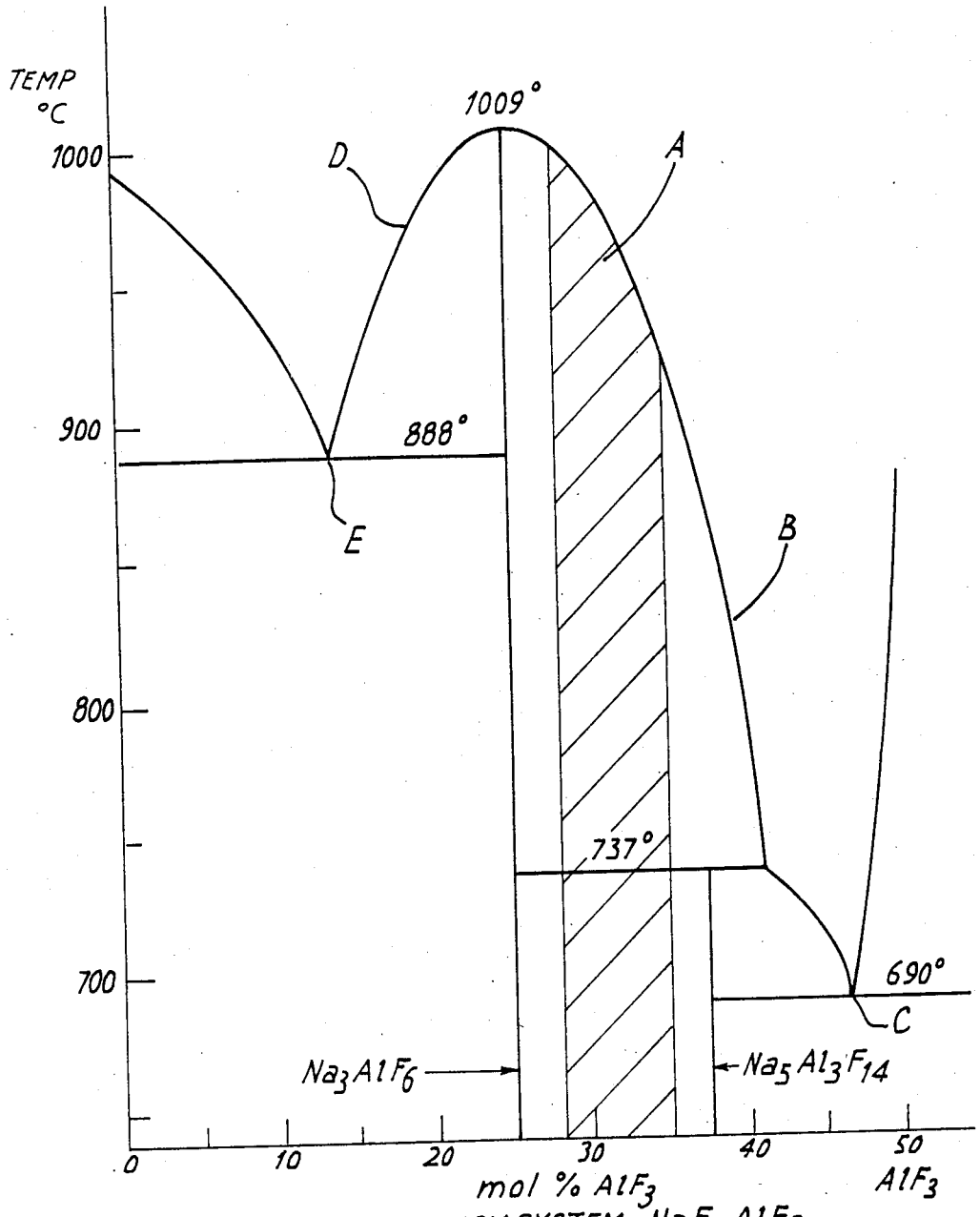

Since the discovery of the process by Hall and Heroult, nearly all aluminium (Al) has been produced by electrolysis of alumina ($Al_2O_3$) dissolved in an electrolyte based on molten cryolite ($Na_3AlF_6$). The Al is deposited molten into a carbon cathode which also serves as a melt container. However, carbon cell linings are not wholly satisfactory; they are expensive; they react slowly with molten Al to form aluminium carbide; they are pervious to molten cryolite; they absorb metallic sodium and are in consequence not dimentionally stable.

Over the years, there have been many proposals to use cell linings based on $Al_2O_3$ in place of carbon. $Al_2O_3$ has the great advantage over carbon that spent linings can simply be used as feed for another cell, thus avoiding material losses and environmental problems. Unlike carbon, $Al_2O_3$ is an electrical insulator, so cells lined with $Al_2O_3$ require cathode current collectors. Again, there have been many proposals to use titanium diboride ($TiB_2$) or other electrically conductive refractory hard metal (RHM) for this purpose. But $TiB_2$ is rather expensive and brittle and difficult to engineer, so that cells using RHM current collectors have not so far achieved any great commercial success. However, efforts are currently being made to improve the technology of $TiB_2$-containing materials, so it is likely that cells with linings based on $Al_2O_3$ and RHM cathode current collectors will become increasingly important.

$Al_2O_3$ is resistant to attack by Al and can hence be used to form the cell floor. $Al_2O_3$ can also be used to form the cell walls, provided a protective layer of frozen electrolyte is maintained on them.

Alumina is quite a good thermal insulator, so that in principle quite thin layers of $Al_2O_3$ are effective to reduce heat loss from the cell. Unfortunately, the cell electrolyte is a mobile liquid, and the grades of $Al_2O_3$ that can most economically be used for lining cells are pervious to molten electrolyte. It is possible to provide an impervious protective layer of fused alumina bricks, but this adds greatly to the cost of the cell, and in any case penetration of liquid eventually occurs.

$Al_2O_3$ saturated with molten electrolyte is a relatively good thermal conductor, so that thicker layers have to be used to reduce heat losses. This increases the expense of the lining and reduces the volume within a given shell that is available for electrolysis, thus increasing capitcal cost. It is an object of the present invention to mitigate this problem.

The invention provides a cell for the production of aluminium by electrolysis of an alumina-containing electrolyte based on molten cryolite, the cell having a lining based on alumina for containing the electrolyte, said lining containing a layer rich in an alkali or alkaline earth metal compound, preferably an alkali metal fluoride, oxide, carbonate or aluminate or an alkaline earth metal oxide or carbonate in free or combined form, which, on penetration of the lining by the electrolyte, dissolves in or reacts with the electrolyte so as to raise the solidus thereof.

U.S. Pat. No. 3,261,699 describes the addition of fluorides of alkali metals, alkaline earth metals and/or aluminium to $Al_2O_3$ refractories intended for use as electrolytic cell linings. The reason for the addition is not clearly stated. No distinction is made between alkali and alkaline earth metal fluorides on the one hand and $AlF_3$ on the other. In fact, alkaline earth metal fluorides do no good and $AlF_3$ is positively harmful for the purposes of the present invention. There is no suggestion that the additive should be confined to a particular layer in the lining.

U.S. Pat. No. 3,607,685 describes cell linings composed of alumina spheres with a binder of calcium fluoride or calcium aluminate. Again, there is no suggestion that the binder should be confined to a particular layer in the lining.

U.S. Pat. No. 4,165,263 describes the establishment of a freeze-line barrier in a cell based on a chloride electrolyte by depositing a sodium-chloride-rich layer in the cell lining from the initial bath, which layer has a solidus above the normal cell lining temperature. This technique involves initially overheating the cell which is not desirable. There is no teaching to incorporate a layer when building the cell lining which will react with the penetrating electrolyte during operation.

In the accompanying drawings;

FIG. 1 is a phase diagram of part of the binary system NaF—$AlF_3$; and

Figures 2A, 2B, 2C:
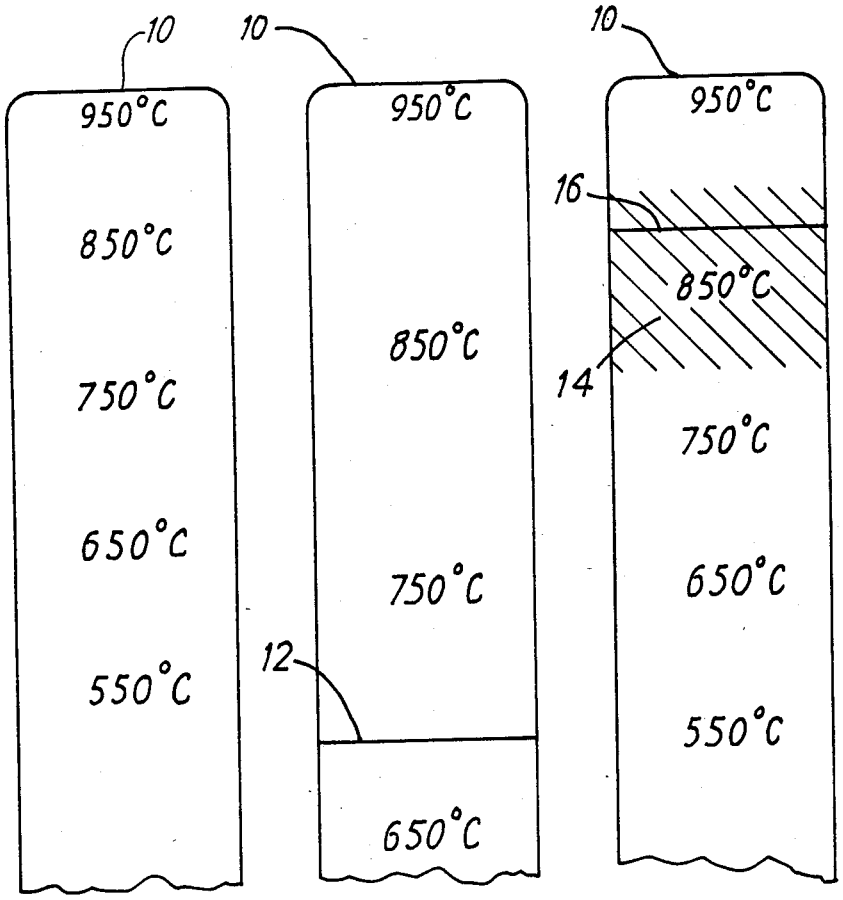

FIGS. 2(*a*), (*b*) and (*c*) are sections through $Al_2O_3$-based cell linings showing temperature profiles.

Referring to FIG. 1, cryolite ($Na_3AlF_6$) contains 25 mol % $AlF_3$ and melts at 1009° C. The operating temperature of electrolytic cells for Al is generally from 950° C. to 980° C. To keep the electrolyte liquid, $AlF_3$ (and other salts) are added, and the $AlF_3$ in the cell electrolyte is generally from 28 to 35 mol %, the band marked as A in the Figure.

FIG. 2 comprises three sections through $Al_2O_3$-based cell linings; (*c*) is an embodiment of the invention, but (*a*) and (*b*) are not. In each case, the top end 10 of the section is in contact with the liquid contents of an electrolytic cell at a temperature of 950° C.

In FIG. 2 (*a*), the cell electrolyte has not penetrated the lining, the temperature of which is shown as dropping in linear proportion with distance from the interior of the cell.

FIG. 2(*b*) shows the same section after penetration thereof by cell electrolyte. Two things have happened. As the electrolyte has percolated downwards, the liquid has improved the thermal conductivity of the bed, with the result that the isotherms are further apart. As the percolating electrolyte cools to its liquidus, cryolite starts to be precipitated, and the temperature-composition profile of the remaining liquid moves down the line B (FIG. 1) until the eutectic point C is reached at 690° C. At this point, marked as 12 in FIG. 2 (*b*), the electrolyte has all solidified, and further penetration does not take place.

FIG. 2 (*c*) is a section through a different $Al_2O_3$-based cell lining, in which there is present a layer 14 rich in an alkali or alkaline earth metal compound, such as sodium in the form of NaF. As the percolating cell electrolyte has reached this layer, the NaF has dissolved in it and changed the composition thereof to the extent that it now contains less than 25 mol % of $AlF_3$. When this modified electrolyte cools to its liquidus, cryolite starts to be precipitated and the temperature-composition profile of the remaining liquid moves down the line D (FIG. 1) until the eutectic point E is reached at 888° C. (In a melt saturated with $Al_2O_3$ this temperature is about 880° C.) At this point, marked 16 in FIG. 2 (*c*), the modified electrolyte has all solidified, and further penetration does not take place. Ultimately, an impervious layer of frozen electrolyte is formed which physically prevents any further penetration.

Comparing FIG. 2 (*c*) with 2 (*b*), it is clear that, by means of this invention, the extent of electrolyte penetration of the cell lining has been greatly reduced, and the various isotherms (e.g. 650° C.) are closer to the interior of the cell, indicating that a thinner lining is required to achieve a desired level of thermal insulation.

NaF is a suitable material to use for the layer 14, but is somewhat expensive and toxic. Other possible sodium compounds include $Na_2O$ or NaOH which are hygroscopic and difficult to handle, $Na_2CO_3$ which gives rise to a problem of $CO_2$ evolution, and sodium aluminate $NaAlO_2$ which is preferred, and which reacts with the cell electrolyte:

$$3NaAlO_2+AlF_3\rightarrow 3NaF+2Al_2O_3$$

Another compound which may be used is $CaCO_3$, which is cheap but gives rise to $CO_2$ evolution problems. Potassium compounds may be used, but are more expensive than the corresponding sodium ones. Sodium compounds have the great advantage, over potassium and calcium, that spent cell linings can simply be broken up and used as feedstock for another cell without the need for intermediate purification. Where sodium is referred to in the following description, it should be understood that other alkali or alkaline earth metals can be used.

In FIG. 2 (*c*), the sodium-rich layer 14 is shown as occupying the region between the 800° C. to 900° C. isotherms. The layer could have been displaced upwards (but with some slight risk of breakthrough of electrolyte); or downwards (with some increase in electrolyte penetration). It could have been made thicker, e.g. by extending it up to the 950° C. isotherm, to the extent of 30–50% of the thickness of the lining. Indeed, the whole lining could in principle have been made rich in sodium. This would have been effective to reduce electrolyte penetration, but would have given rise to spent linings that contained so much sodium that they could not be used as cell feed without excessive consumption of $AlF_3$ to react with it. So the present invention does not contemplate cells in which the whole lining is sodium-rich. According to the invention, the cell lining contains a sodium-rich layer. This layer preferably includes the 800° isotherm (when the cell is in operation). And the layer preferably contains no more sodium than is necessary to prevent penetration by electrolyte.

Alumina (which term is used to include both alpha-alumina $Al_2O_3$ and beta-alumina $NaAl_{11}O_{17}$) may be used alone or together with conventional binders and/or other lining materials. However there is an advantage if the alumina is in a form which is thermodynamically stable with respect to the alkali or alkaline earth metal compound which is added. In the case of sodium aluminate additive this means that beta-alumina is preferred to alpha-alumina. In the layer that includes the alkali or alkaline earth metal compound, a preferred lining comprises shapes, e.g. balls, of alumina, more preferably beta-alumina, in a packed bed of beta-alumina powder. When the lining is being build up by compacting a particulate material, it is a simple matter to include a sodium-rich layer at a desired distance below the working surface of the lining.

EXAMPLE

A 16 KA aluminum reduction Hall-Heroult cell was given the following bottom lining (from the bottom up).

1. 200 mm of unground alpha-alumina powder.
2. 200 mm of unground alpha-alumina powder containing 11.7 wt % of sodium aluminate ($NaAlO_2$) dried overnight at 300° C.
3. 100 mm of tabular alumina shapes approximately 2 cm in size, with the spaces between the shapes filled with the powder containing 64 wt.%, unground alpha-alumina and 36% $NaAlO_2$.
4. 350 mm of tabular alumina shapes as in Layer 3 with spaces between the shapes filled with crushed tabular alumina 42 wt.%, alpha-alumina powder 13 wt. %, and sodium aluminate 45 wt. %.

This gave the total depth of the lining of 850 mm. During the operation, this lining was in direct contact with 150–200 mm thick pool of molten metal aluminum and 150–200 mm of $NaF$-$AlF_3$-$CaF_2$ molten electrolyte having the weight ratio ($NaF/AlF_3$) of 1.25 and containing 5 wt. % of $CaF_2$. Alumina concentration in the molten electrolyte during the operation was 2–3 wt. % and the cell temperature was maintained between 970° and 990° C. There was no provision made to prevent contact of the electrolyte or sludge with the top of the bottom lining aggregate.

During the operation, the electrolyte losses from the liquid zone attributed to soaking of the liquid into the lining were surprisingly lower than those commonly observed with the conventionally carbon lined cells. There was no appreciable dissolution or loss of the alumina aggregate lining and the alumina content of the electrolyte, the electrolyte composition, and anode effect frequency were not affected by the non-carbon bottom lining.

The cell was operated for a period of 32 days. It was then shut down and post mortem analysis was performed. Electrolyte was found to have penetrated the lining only 150 mm. Below that layer there was 40 mm thick layer in which there was recrystallization of aggregate between the tabular alumina shapes. In the vicinity of the limit of bath penetration, the tabular alumina balls were found to transform to beta-alumina ($NaAl_{11}O_{17}$). The aggregate below that layer remained powdery and macroscopically unchanged.

It will be noted that the sodium-rich layer built into the bottom lining (650 mm out of a total lining thickness of 850 mm) was much thicker than was actually necessary to contain the electrolyte. A thinner layer would be used in a cell intended for commercial operation.

What is claimed is:

1. A cell for the production of aluminium by electrolysis of an alumina-containing electrolyte based on molten cryolite, the cell having a lining based on alumina for containing the electrolyte, said lining containing a layer rich in a sodium compound and which includes alumina in a form which is thermodynamically stable with respect to the sodium compound, used, which layer, on penetration of the lining by the electrolyte, dissolves in or reacts with the electrolyte so as to raise the solidus thereof.

2. A cell as claimed in claim 1, wherein the sodium compound is sodium aluminate.

3. A cell as claimed in claim 1 wherein the layer encompasses the 880° C. isotherm when the cell is in operation.

4. A cell as claimed in claim 1 wherein the layer includes beta-alumina.

5. A cell as claimed in claim 1, wherein the layer comprises shapes of alumina in a packed bed of beta-alumina powder.

6. A cell as claimed in claim 5, wherein the layer comprises shapes of tabular alumina in a packed bed of powdered beta-alumina and sodium aluminate.

7. A cell as claimed in claim 5, wherein the layer comprises shapes of beta-alumina in a packed bed of powdered beta-alumina and sodium aluminate.

* * * * *

UNITED STATES PATENT AND TRADEMARK OFFICE

CERTIFICATE OF CORRECTION

PATENT NO. : 4,647,357

DATED : March 3, 1987

INVENTOR(S) : Ernest W. Dewing

It is certified that error appears in the above-identified patent and that said Letters Patent is hereby corrected as shown below:

On the Title Page, Item [75].

Change the inventors from "Ernest W. Dewing" to --Ernest W. Dewing and Bohdan Gnyra-- .

Signed and Sealed this

Twenty-third Day of August, 1988

*Attest:*

DONALD J. QUIGG

*Attesting Officer*

*Commissioner of Patents and Trademarks*